US007428792B2

(12) United States Patent
Kochan et al.

(10) Patent No.: US 7,428,792 B2
(45) Date of Patent: Sep. 30, 2008

(54) DISPLAY DEVICE

(76) Inventors: William Kochan, 1319 East 62 Avenue, Vancouver, British Columbia (CA) V5X 2H4; Gene A. Augustine, 654 Austin Avenue, Coquitlam, British Columbia (CA) V3K 3N1; Ray Augustine, 1810 Harbour Drive, Coquitlam, British Columbia (CA) V3J 5W7

( * ) Notice: Subject to any disclaimer, the term of this patent is extended or adjusted under 35 U.S.C. 154(b) by 334 days.

(21) Appl. No.: 10/555,204

(22) PCT Filed: Feb. 16, 2004

(86) PCT No.: PCT/CA2004/000212

§ 371 (c)(1),
(2), (4) Date: Nov. 1, 2005

(87) PCT Pub. No.: WO2004/097771

PCT Pub. Date: Nov. 11, 2004

(65) Prior Publication Data

US 2006/0207142 A1 Sep. 21, 2006

(30) Foreign Application Priority Data

May 1, 2003 (CA) ..... 2427885

(51) Int. Cl.
*G09F 21/02* (2006.01)

(52) U.S. Cl. ..... 40/586; 40/604; 40/610; 40/514

(58) Field of Classification Search ..... 40/586, 40/603, 604, 610, 904, 514, 515, 516, 517, 40/317, 334; 116/173, 174, 63 P; D11/166
See application file for complete search history.

(56) References Cited

U.S. PATENT DOCUMENTS 363,345 A * 5/1887 Price et al. ..... 116/173
938,221 A * 10/1909 Dallimore ..... 116/173

(Continued)

FOREIGN PATENT DOCUMENTS

FR 2356177 1/1978

(Continued)

*Primary Examiner*—Gary C Hoge
(74) *Attorney, Agent, or Firm*—Oyen Wiggs Green + Mutala LLP

(57) ABSTRACT

A display device, according to the present invention, taking the form of a scroll with handle (201) and spool-rod shaft (202) for rolling and unrolling printed flexible material (400) and a tubular housing (300) with an internal chamber—a floating cowling—freely rotatable over said wound spool-rod from which the printed material is extendable. The scroll text (400) or image to be viewed is manually extendable by pulling it through a continuous longitudinal slot (301) in the cowling with a pull-tab (501) which also prevents the printed material from being irretrievably drawn into the cowling. The cowling is rotatably received at its open ends over the spool-rod by a pair of opposed retaining/aligning yokes. The invention improves on traditional scrolls by providing protective containment for the printed material without requiring the containment's separation to display it. The cowling and handle are adaptable as works of art related to the printed material.

9 Claims, 8 Drawing Sheets

100

U.S. PATENT DOCUMENTS

| | | | | | |
|---|---|---|---|---|---|
| 1,153,206 | A | * | 9/1915 | Eisenberg | 446/180 |
| 1,305,885 | A | * | 6/1919 | Coe | 116/173 |
| 1,662,190 | A | * | 3/1928 | Jones | 116/173 |
| 1,896,832 | A | * | 2/1933 | Wiley | 116/173 |
| 2,061,361 | A | * | 11/1936 | Lane | 116/173 |
| 2,518,280 | A | * | 8/1950 | Buckner, Jr. | 116/173 |
| 2,533,459 | A | * | 12/1950 | Holliday | 116/173 |
| 4,332,210 | A | * | 6/1982 | Lambert | 116/173 |
| 4,800,834 | A | * | 1/1989 | Feng | 116/173 |
| 4,944,656 | A | * | 7/1990 | Feng et al. | 116/173 |
| 4,984,379 | A | * | 1/1991 | Lee | 40/334 |
| 5,005,512 | A | * | 4/1991 | Fu | 116/173 |
| 5,924,869 | A | | 7/1999 | Haas | |
| 5,966,854 | A | | 10/1999 | Walsh et al. | |
| 6,038,800 | A | | 3/2000 | Seidel | |
| 6,201,587 | B1 | | 3/2001 | Sakamaki | |
| 6,553,929 | B1 | * | 4/2003 | Harp | 116/173 |
| 2001/0025898 | A1 | | 10/2001 | Arrane | |
| 2003/0200683 | A1 | * | 10/2003 | Gailen | 40/586 |

FOREIGN PATENT DOCUMENTS

| | | |
|---|---|---|
| JP | 9216465 | 8/1997 |

* cited by examiner

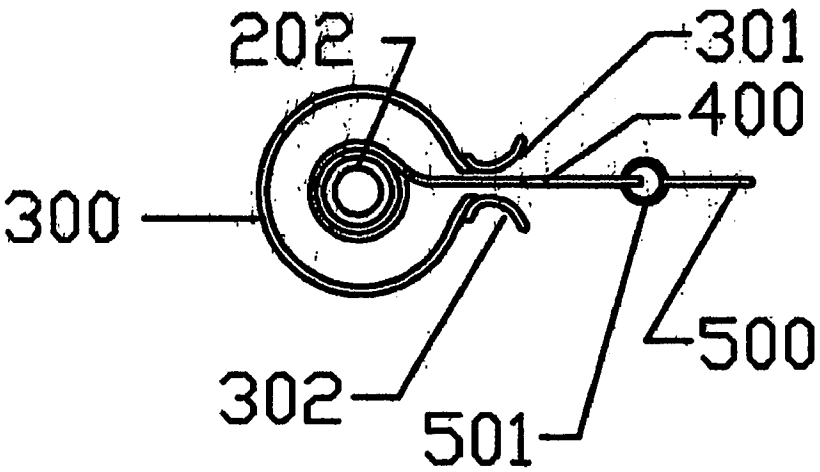
FIG 3A
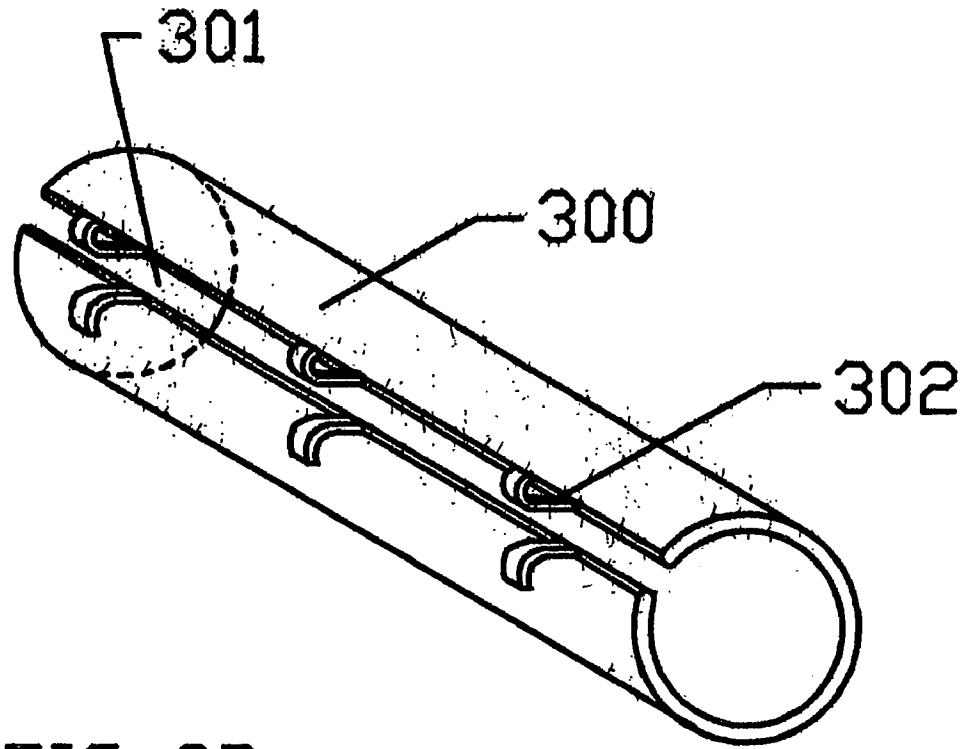
FIG 3B
FIGURE 3

100.4

DISPLAY DEVICE

BACKGROUND OF THE INVENTION

1. Field of the Invention

The present invention relates to a display device particularly adapted to expose flexible printed material through a protective and decorative freely rotatable tubular housing—a floating cowling—requiring no removal to expose or re-contain the printed material.

2. Description of the Prior Art

Prior containments for flags, scrolls, posters, maps and the like were required to be removed or deliberately opened or separated from the printed material they contain and therefore increased the amount of time and effort required before using the device for its principal functions of displaying the printed subject matter and its effective containment. Other containment/dispensing means required the device be fixed to a substantial structural support eliminating the portability of the device while in use whereas the present invention is hand-held. This device manifests a further improvement on other containment/dispensing means for rolled printed material in that it does not utilize springs, gears, motors or any other mechanical method more complicated than manual retraction and extension by simply rotating one's wrist and fingers. The following disclosures relate to various partial solutions to the problem of efficiently incorporating types of housings for display devices such that the housing's separation from the device is not required to effectively display the printed material therein:

Seidel (U.S. Pat. No. 6,038,800, issued Mar. 21, 2000); Haas (U.S. Pat. No. 5,924,869, issued Jul. 20, 1999); Stanley (U.S. Pat. No. 6,155,197, issued Dec. 5, 2000); Jennings (U.S. Pat. No. 4,825,571, issued May 2, 1989); Welsh (Can. Patent No. 2,160,612, filed Oct. 16, 1995); Cornell (U.S. Pat. No. 4,345,392, issued Aug. 24, 1982); Hasten (U.S. Pat. No. 6,006,900, issued Dec. 28, 1999); Augustine (U.S. Patent Application No. 20020056214 Ser. No. 09/862,142, filed May 2, 2001). The inventors believe that the cited disclosures taken alone or in combination neither anticipate nor render obvious the present invention. The foregoing citation does not constitute an admission that such disclosures are relevant or material to the claimed subject matter, rather, the disclosures relate only to the general fields of the invention and are cited as constituting the closest art of which the inventors are aware.

SUMMARY OF THE INVENTION

An objective of the invention is to provide a mechanically minimized hand held display device that exposes text and/or images to be viewed in entirety or in incremental portions of a flexible material adapted to be manually extendable from and retractable into, the interior of a tubular housing that freely rotates over the spool-rod—the essence and distinguishing feature of the present invention—around which the flexible material is wrapped.

The display device comprises five principle parts:

(a) an axial shaft comprising two rotationally and axially fixed sections those being a handle means and a spool-rod means which is of a substantially reduced diameter with respect to the internal diameter of the tubular housing so that ample spacing is left within the tubular housing around the spool-rod for the disposition of the printed flexible material;

(b) a tubular housing portion—hereafter to be understood for the present invention as a floating cowling—of a semi-rigid plastic material that is capable of manual elastic deformation that permits a snap-on fit over retaining/aligning yokes where it is receivable and freely rotatable around aforesaid spool-rod means and which protects, contains and from which the printed material can be extended through a longitudinal axial slot;

(c) two retaining/aligning yokes—hereafter to be understood for the present invention as the mid-shaft and distal retaining/aligning yokes—axially and rotationally fixed to the axial shaft, one yoke located mid-shaft between the handle and spool-rod sections of the axial shaft and the other yoke at the distal end of the spool-rod section, and both with facing raised annular circumferential ridges recessed from the yokes' outer rim, both fixed perpendicular to the axial shaft and in parallel planes to each other and of a distance apart substantially equal to the longitudinal length of the floating cowling such that they not only effectively close the floating cowling open ends but also rotationally support and axially align the cowling over the spool-rod section;

(d) a pull-tab means fixed to the free end of the printed flexible material which is used to facilitate the manual extension of the printed material from within the floating cowling and to prevent the free end of the printed material from being completely drawn inside the tubular housing as it is being rewound and furthermore, on fill retraction, to seal the longitudinal slit in the floating cowling completing the protective enclosure of the printed material contained therein; and (e) the flexible printed material.

In another aspect of this invention, the distal retaining/aligning yoke is detachably joined to the spool-rod shaft distal end which is threaded to be received by a threaded blind hole in the centre of the distal yoke. In this aspect, the floating cowling is lowered over the spool-rod shaft, its proximal open end being internally received by a raised annular circumferential ridge recessed from the perimeter on the facing plane of the mid-shaft retaining/aligning yoke, then rotatably retained in a longitudinally aligned position around the spool-rod shaft by applying the complementary threaded distal yoke, the raised annular ridge on its internal facing plane which receives the internal open distal end of the floating cowling in a loose running fit. The detachability of this yoke allows a more rigid material such as harder plastic, wood or metal to be utilized as a durable and carvable cowling construction material increasing cowling service life and decorative options.

In yet another aspect of this invention, the distal and mid axial shaft retaining/aligning yokes are fixed to the axial shaft and shaped cap-like with elongated circumferential side walls replacing the yoke perimeter recessed raised annular concentric ridges as an retaining/aligning means for the floating cowling. The distal end of the floating cowling—the leading end in this variation—is sloped on a bias allowing the leading end to be inserted—vertically raised—into the cap-like distal retaining/aligning yoke and, because the cowling's longitudinal slit in this variation is aligned with, and slightly wider than, the diameter of the spool-rod shaft, the body of the cowling will pass over the spool-rod shaft, moving slidabably upward, clearing the mid-axial shaft yoke elongated circumferential side wall until the cowling is longitudinally parallel to the spool-rod shaft when it can then be lowered into the cap-like mid-axial shaft retaining/aligning yoke. The internal circular planar faces of said opposed yokes are fixed longitudinally on the axial shaft bracketing the spool-rod section a distance apart slightly greater than the length of the cowling. Each of these opposed retaining/aligning yokes has an outside perimeter circumferential side wall fixed and perpendicular to their respective circular internal planar faces and of a height above said planar faces such that they are coextensive with the ends of the floating cowling they rotatably receive. The cap-like structures of said yokes with side walls have an internal diameter slightly greater than the external diameter of the floating cowling providing a loose running fit permitting axial rotatability about the spool-rod shaft and slidable upward (longitudinal) removability just as with a removable window sash from tracked frame. The removal and replacement of this cowling can only be accomplished with the printed material unwound from the shaft as the longitudinal slit is designed such that its opening width runs a close running fit with the spool-rod shaft diameter. In fact, this is the intent of the design, as when the printed material is wound even one rotation around the spool-rod shaft, the increased diameter dimension this imparts to the shaft is sufficient to ensure the cowling cannot be removed or fall from its rotatable position around its longitudinal axis.

In still another embodiment of the present invention, the floating cowling is supported in a rotatably receivable position along its longitudinal axis around the spool-rod section by internal fixed circumferential ridges on the cowling recessed from the distal and proximal cowling open ends at an internal distance apart substantially equal to the co-axially positioned retaining/aligning yokes of the spool-rod. In this variation, on rotatably receiving the floating cowling around the spool-rod, the distal retaining/aligning yoke is detachably joined to the spool-rod distal end which is threaded to be received by a threaded blind hole in the center of the interior facing surface of the distal retaining/aligning yoke. The detachability of the distal yoke and spool-rod at the distal end may be accomplished by other attaching means with equal effectiveness such as opposed polarity rare earth magnets. The outer perimeter edge of the yokes and the cowling internal circumferential ridge face of the floating cowling meet in a loose running fit. The interior facing surface of the mid-axial shaft retaining/aligning yoke and the exterior facing surface of the floating cowling proximal internal ridge and the interior facing surface of the distal retaining/aligning yoke and exterior facing surface of the cowling distal internal ridge rest on each other with negligible resistance to rotatability due to the light loads on the bearing surfaces, the smoothness of the planar contact faces, and a symmetrical but loose running fit because the retaining/aligning yokes have a radius of curvature slightly less than the radius of curvature of the interior of the floating cowling. The yokes are also positioned a distance apart on the axial shaft slightly greater than the distance apart of the internal circumferential ridges of the cowling. The pressure of the flexible printed material being withdrawn into or extended from the cowling internal chamber through the cowling longitudinal slit will easily overcome any static inertia of the cowling relative to the yokes and cause the cowling to freely rotate around the spool-rod. Unlike other means in retaining the cowling as discussed for the present invention, this method conceals the retaining/aligning yokes creating a larger uninterrupted, and therefore more aesthetic, surface area for the viewing of art and/or indicia on the cowling external face.

In still another variation of the present invention, the handle means is deleted and the free-floating cowling serves the dual purpose of containment means and holding means. The tubular floating cowling remains rotatably received by the distal—formerly called the mid axial shaft retaining/aligning yoke in the preceding summary—and proximal retaining/aligning yokes but is now gripped by one hand allowing the spool-rod and attached retaining/aligning yokes to spin feely relative to the cowling as the flexible printed material is manually extended through the cowling longitudinal slit by pulling on the pull-tab means. In this variation the printed material is still retracted into the internal chamber of the cowling around the spool-rod by hand manipulation of either cap-like retaining/aligning yoke in a dial-like manner. In this variation the cowling will be constructed of a rigid material sufficiently strong enough to resist deformation when gripped. One of the retaining/aligning yokes will be threadably detachable or the yokes will be fixed to the spool-rod shaft and of the cap-like design that permits the insertability of a rigid cowling and its retention in rotatable position by the partial coextension of the yoke cap sidewalls and the cowling distal and proximal ends.

Another objective of the present invention is for the exterior to be adaptable as a vehicle for the overt display of indicia and/or art of a subject or theme related to the printed material it is principally intended to display such that the vendor and purchaser are overtly aware of the content subject matter of the display device when in the closed/rolled up position. Through the direct association of the printed contents and art/indicia on the visible portions of the cowling, handle and distal yoke surface, storage and display are made by logical thematic groupings such as flags by nation or text by subject which will facilitate inventory re-stocking and counting and customer selection in much the same manner, and for like reasons, as a retail book store stocks its shelves.

In another aspect of this invention, a second display device is employed to retract and extend the printed material instead of the pull-tab means such that as the printed material being manually extended from one device it is being simultaneously rewound into the second. The distance between the devices which the operator chooses determines the amount of exposed printed material desired to be viewed. In this embodiment of the invention, both edges of the longitudinal axial slit of the floating cowling must be adapted with a rolled edge or ski-tip type guides to prevent frictional binding of the face of the printed material against the cowling longitudinal slit which would otherwise bind and then wrap the printed material around the cowling instead of permitting and enhancing its retraction into the receiving cowling chamber.

BRIEF DESCRIPTION OF THE DRAWINGS

Although the characteristic features of this invention will be particularly pointed out in the claims, the invention itself and the manner in which it may be made and used, may be better understood by referring to the following description and accompanying drawings.

Like reference numerals refer to like parts throughout the several views of the drawings in which:

FIG. 3 illustrates the cowling no-bind ski tip ends

DESCRIPTION OF THE PREFERRED EMBODIMENT

Figure 1:
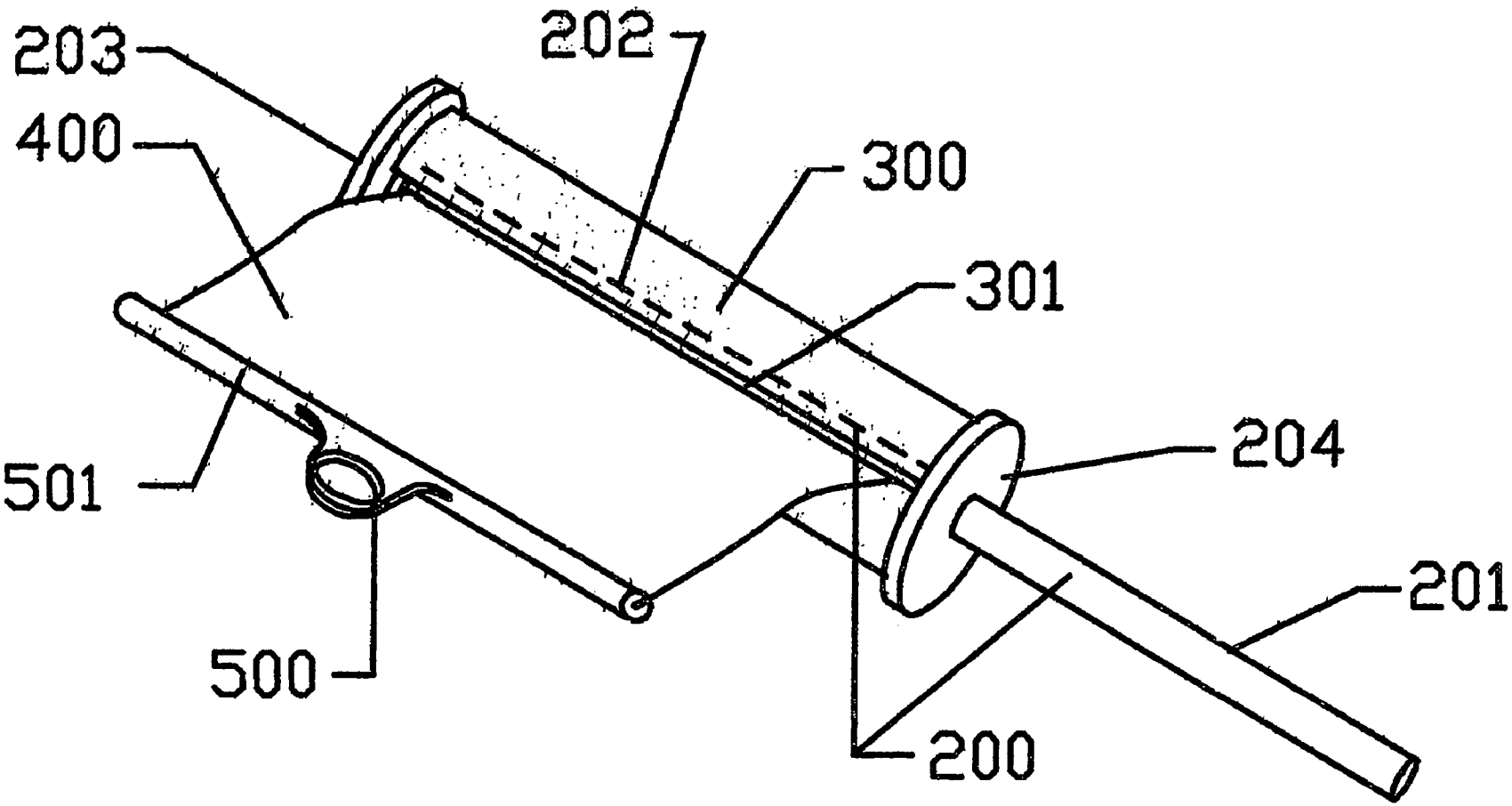
FIG. 1 illustrates the representative display device

Turning to FIG. 1, the display device 100 conforming the present invention comprises an axial shaft 200 of two rotationally fixed sections, the handle means section 201 and the spool-rod means section 202. A tubular housing designated by the inventors as the free floating cowling 300 with internal chamber and longitudinal slit 301 is positioned over the spool-rod means section 202 and restricted to rotation around the spool-rod section about its longitudinal axis by spool-rod shaft distal end retaining/aligning yoke 203 and mid-axial shaft retaining/aligning yoke 204. The spool-rod means 202 is of substantially reduced diameter with respect to the internal diameter of the floating cowling 300 so that ample spacing is left within the cowling internal chamber around the spool-rod 202 for the disposition of the printed flexible material 400. A continuous ribbon 400 of printed flexible material is attached at one end to the spool-rod means section 202 and at its free end—the leading end—is attached to the pull-tab means 500 along its spine section 501 by which the flexible material is drawn from the spool-rod 202 through the longitudinal slit 301 in conjunction with the simultaneous manual rotation of the handle section 201 about its longitudinal axis. The manner of attaching the printed flexible material 400 to the spool-rod 202 can be achieved by a variety of methods involving adhesives or low head profile fasteners such as staples embedded in the body of the spool-rod 202. The fixed end of the printed flexible material 400 must be attached to the spool-rod 202 such that it is always wound onto or withdrawn from the spool-rod at an angle of ninety degrees relative to the axis of the spool-rod. The pull tab means 500 is designed such that the spine 501 is of a length and diameter that will, on full retraction, nest within the opening of longitudinal slit 301 effectively sealing the slit opening into the floating cowling but cannot be drawn inside. The pressure of the flexible printed material 400 being withdrawn into or extended from the floating cowling 300 internal chamber through the cowling longitudinal slit 301 as the handle means 201 is rotated will easily overcome any static inertia of the floating cowling 300 relative to the axial shaft 200 and cause the floating cowling 300 to freely rotate around the spool-rod 202 while being aligned by retaining/aligning yokes 203 and 204. This manual action will expose a sequence of text or images to the eye of the viewer.

Figure 2:
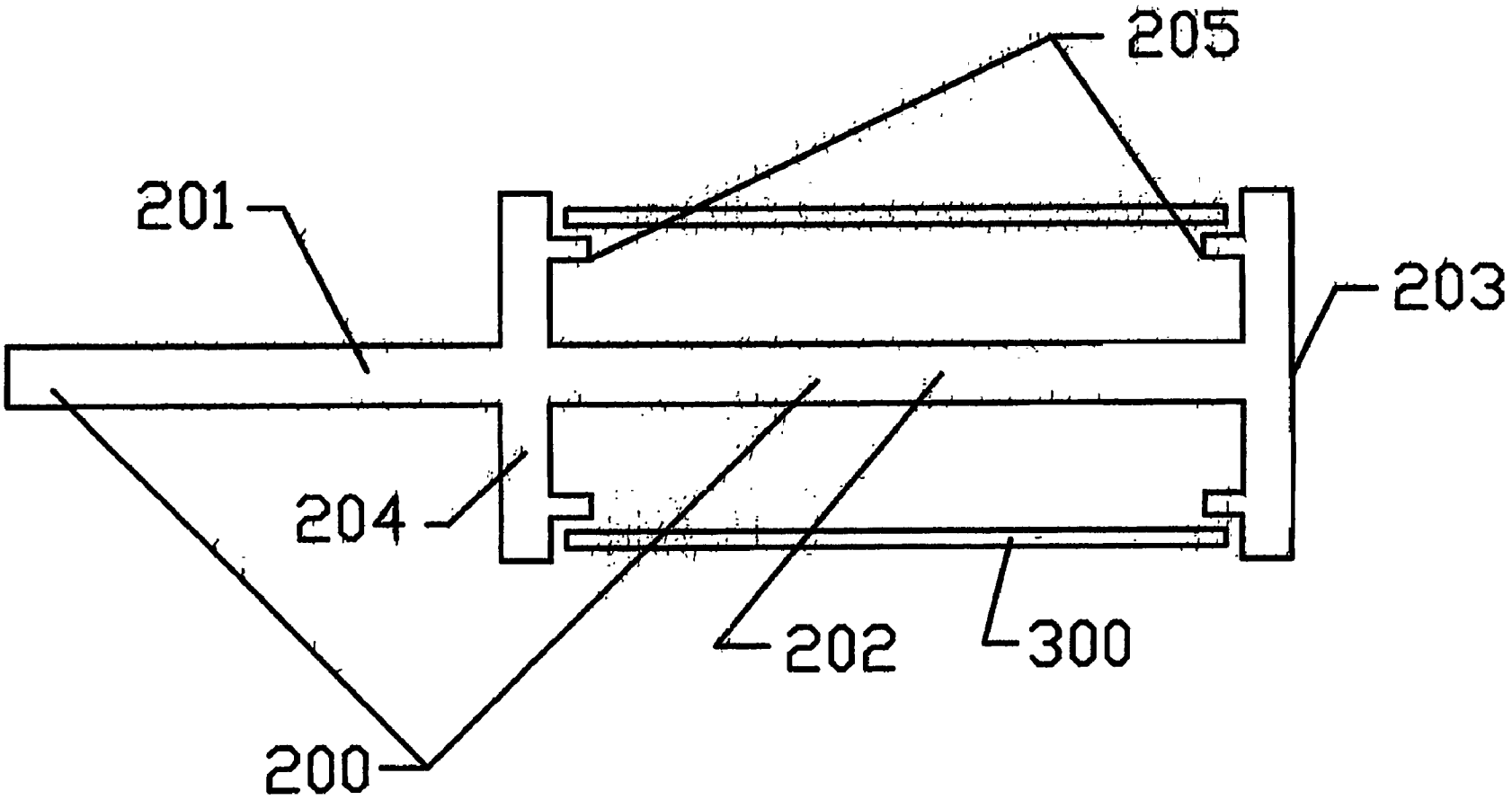
FIG. 2 illustrates the snap-on cowling assembly

Now referring to FIG. 2, we see in cross section the display device 100 in its simplest form comprising the axial shaft 200, itself comprised of the permanently engaged handle section 201 and spool-rod section 202, and the tubular housing of the floating cowling 300 positioned over the spool-rod section 202. The free floating cowling 300 is restricted to rotation about its longitudinal axis by continuous concentric annular ridges 205 raised on the otherwise smooth, planar and mutually facing surfaces of spool-rod distal end retaining/aligning yoke 203 and mid-axial shaft retaining/aligning yoke 204. Both retaining/aligning yokes 203 and 204 are rotationally and axially fixed to axial shaft 200, co-axially positioned and of a distance apart substantially equal to the longitudinal length of the floating cowling 300 not only serving to close the open ends of the floating cowling 300 but to rotatably support and uniformly align the floating cowling 300 equidistant around the spool rod 202. In this embodiment of the invention, the floating cowling 300 is made of thin wall semi-rigid plastic which due to its elastic properties permits the manual deformation of the cowling facilitating its snap-on positioning between the retaining/aligning yokes 203 and 204 and in a loose running fit around the outside perimeter of the raised and recessed annular circumferential ridges 205 of the supporting retaining/aligning yokes 203 and 204. Annular ridges 205 have a square cross section and rise perpendicular to the planar face of the retaining/aligning yokes 203 and 204 to an altitude above said planar faces and of a distance apart substantially less than the longitudinal length of the floating cowling 300 sufficient to prevent the floating cowling 300 from any alignment other than parallel to and radially equidistant around spool-rod means 202.

FIG. 3 is comprised of FIGS. 3A, and 3B. In FIG. 3B, the floating cowling 300 with internal chamber is shown displaying longitudinal slit 301 from which the flexible material 400, unrolled from spool-rod 202 is withdrawn through and drawn into, and ski-tip guides 302 which prevent frictional binding of the printed material on retraction into the interior chamber of the floating cowling 300. FIG. 3A shows the cross section of the floating cowling 300—and how the spine section 501 of the pull tab means 500 nests into the longitudinal slit 301 with curled out edges (not shown in any figure) or ski tip guides 302 effectively sealing the printed material 400 within the internal chamber and wrapped evenly around spool-rod 202.

Figure 4:
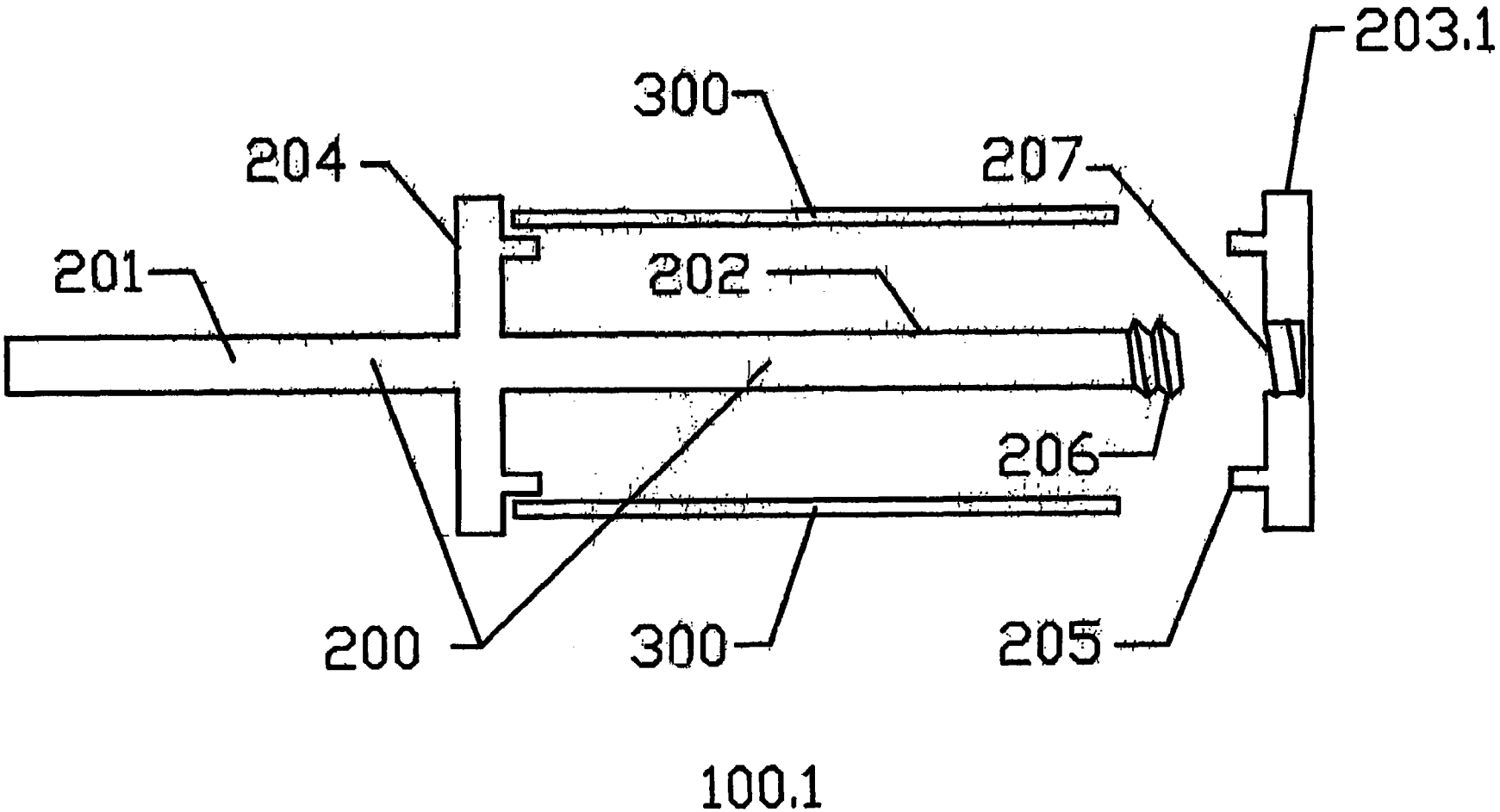
FIG. 4 illustrates the detachable distal yoke

FIG. 4 shows another embodiment of the invention—100.1—wherein the spool-rod distal end retaining/aligning yoke 203 of FIG. 2 now becomes detachably joined through threaded engagement 206 of the spool-rod shaft distal end into the receiving threaded blind hole 207 in the body of distal retaining/aligning yoke, now designated 203.1. In this variation, the detachability of said distal retaining/aligning yoke 203.1 permits the use of a floating cowling 300 made of rigid material now placed in rotatable and uniformly parallel aligned position around the spool rod 202 by lowering it over said distally unyoked spool-rod 202, over and around the raised annular ridge 205 of mid-axial shaft retaining/aligning yoke 204, and then applying the threadably attached distal retaining/aligning yoke 203.1 such that its raised annular ridge 205 internally engages the cowling in a loose running fit.

Figure 5:
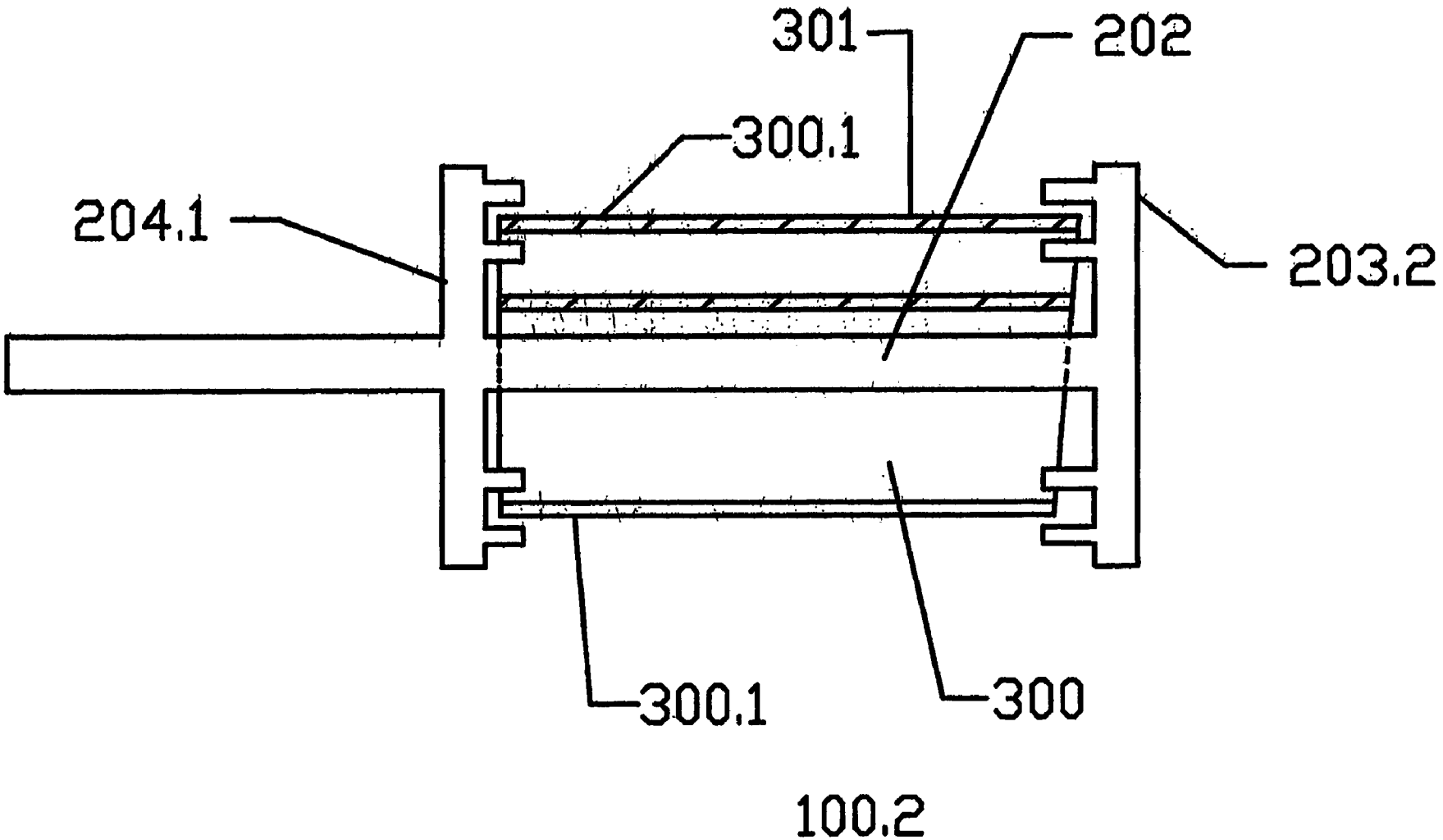
FIG. 5 illustrates the slidably insertable cowling

FIG. 5 shows another variation in the invention—100.2—wherein the retaining/aligning yokes 203.2 and 204.1 and the floating cowling 300.1 represent variations in retaining/aligning yokes 203 and 204 and floating cowling 300 from FIG. 1 that permit a rigid floating cowling to be utilized in conjunction with a permanently engaged distal end retaining/aligning yoke 203.2. This is accomplished by slipping the distal bias cut end of the floating cowling 300.1 slidably upward into distal retaining/aligning yoke 203.2 which has elongated circumferential side walls, while aligning the cowling longitudinal slit 301 and spool-rod 202 shaft and simultaneously sliding the cowling over spool-rod shaft 202 which must be unwound of printed material at the time of insertion to present the smallest possible shaft diameter that can pass closely through the aligned cowling slot. After upwardly sliding the cowling 300.1 over spool-rod 202 the cowling is then lowered into the round cap-like shape of mid-axial retaining/aligning yoke 204.1—created by the elongated circumferential interior facing side walls of said mid-axial yoke—where it is rotatably received about its longitudinal axis. The cowling length is sufficiently less than the distance between the internal planar faces of the cap-like retaining/aligning yokes 203.2 and 204.1 but such that it is still rotatably retained by the elongated circumferential sidewalls of said cap-like yokes working in tandem between which the cowling resides.

Figure 6:
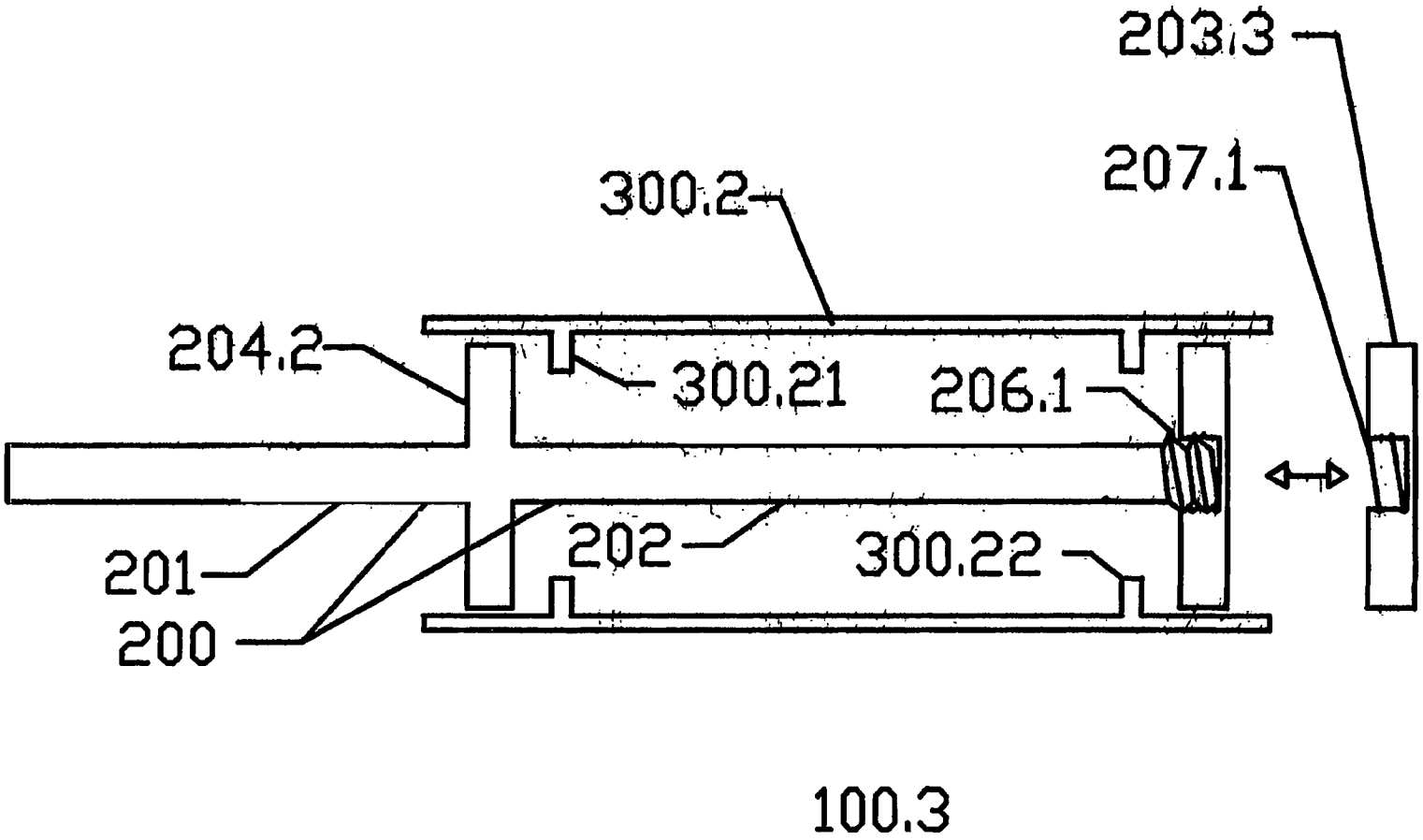
FIG. 6 illustrates the concealed yoke mechanism

FIG. 6 shows another form of the present invention—100.3—in which the floating cowling 300.2 is supported in a rotatably receivable position along its longitudinal axis around the spool-rod section 202 by two internal fixed circumferential ridges 300.21 and 300.22 which encircle the cowling interior peripheral wall and are recessed from the distal and proximal cowling open ends at an internal distance apart substantially equal to the distance between the co-axially fixed retaining/aligning yoke 204.2 and the threadably attached retaining/aligning yoke 203.3 positions on axial shaft 200. In this variation, on rotatably receiving the floating cowling around the spool-rod 202, the distal retaining/aligning yoke 203.3 is detachably joined to spool-rod 202 distal end 206.1 which is threaded to be received by threaded blind hole 207.1 in the center of the interior facing surface of the distal retaining/aligning yoke 203.3. The detachability of distal retaining/aligning yoke 203.3 and spool-rod 202 at the distal end may be accomplished by other attaching means with equal effectiveness; one such alternative means being opposed polarity rare earth magnets (no alternate attachment means are shown). The outer perimeter edge of the retaining/aligning yokes 204.2 and 203.3 and the corresponding internal fixed circumferential ridges 300.21 and 300.22 of the floating cowling 300.2 rotationally engage in a loose running fit. The interior facing surface of the mid-axial shaft retaining/aligning yoke 204.2 and the exterior facing surface of the floating cowling proximal internal ridge 300.21 and the interior facing surface of the distal retaining/aligning yoke 203.3 and exterior facing surface of the cowling distal internal ridge 300.22 rest on each other with negligible resistance to rotatability due to the light loads on the bearing surfaces, the smoothness of the planar contact faces, and a symmetrical but loose running fit because the yokes have a radius of curvature slightly less than the radius of curvature of the interior of the floating cowling 300.2 and because the retaining/aligning yokes are positioned a distance apart on the axial shaft slightly greater than the distance apart of the internal fixed circumferential ridges 300.21 and 300.22 of the cowling 300.2. As with all other retaining/aligning means described as variations in the present invention, this method retains the cowling in a freely rotatable position equidistant around the spool-rod 202 in a restricted axial position relative to the axial shaft handle means 200.

Figure 7:
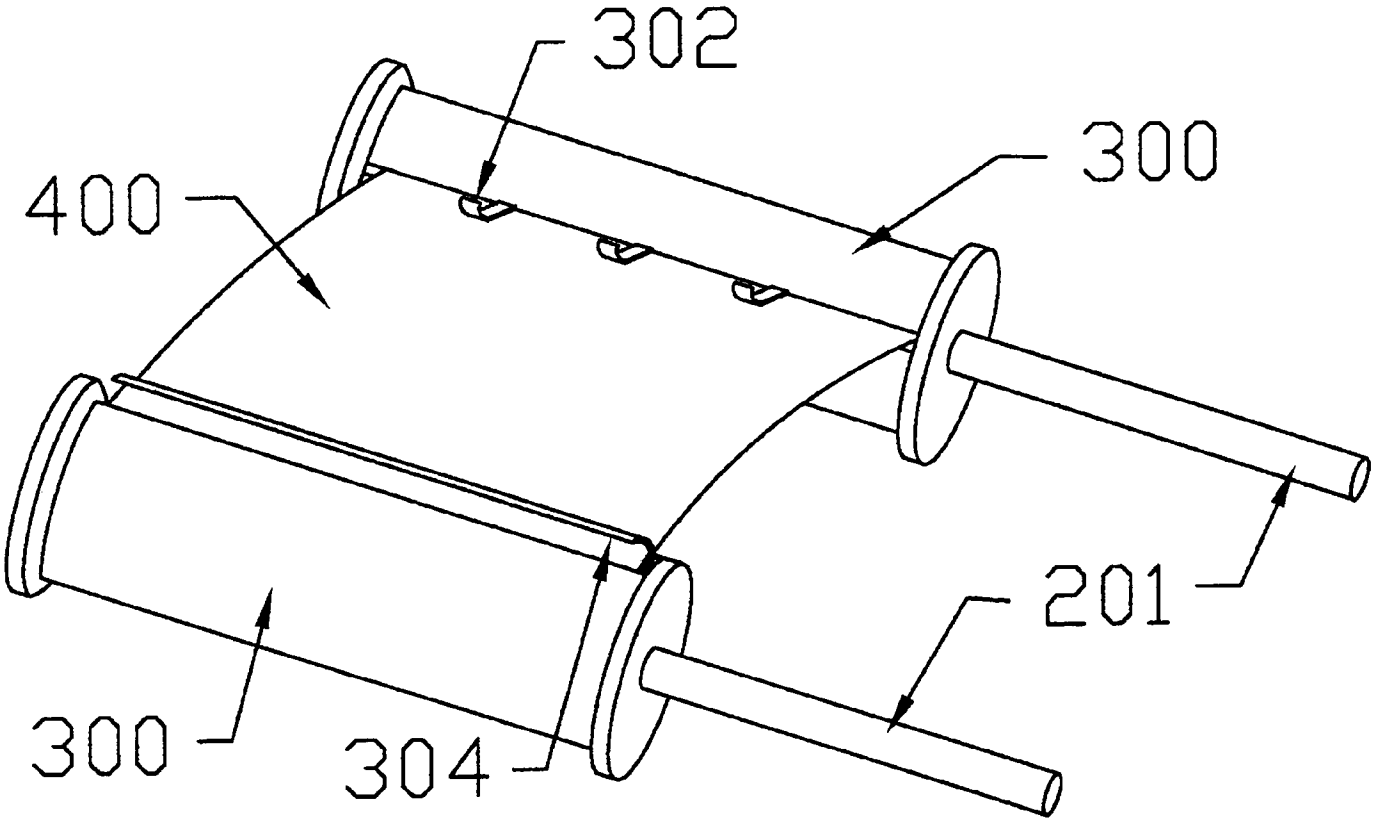
FIG. 7 illustrates twinned device variation

FIG. 7 shows yet another aspect of the present invention—100.4—which essentially comprises two structurally identical display devices, as per FIG. 1, now mutually connected by the printed flexible material 400 adapting them to be held substantially apart and parallel to each other by the twinned handle means's 201. By intermittently and simultaneously rotating both the first and second devices a sequence of text and/or images is exposed to the eye of the viewer. It is in this form of the present invention that the ski-tip guides 302—which may also take the form of continuous outwardly rolled edges 304—of the longitudinal slits 301 (not shown in drawing) in the floating cowlings 300 are required to prevent the binding of the flexible printed material 400 against a straight cowling edge and consequently wrapping around the receiving cowling as will be encountered by one unskilled or less attentive in operating the device who applies less than optimum tension between the twinned devices.

Figure 8:
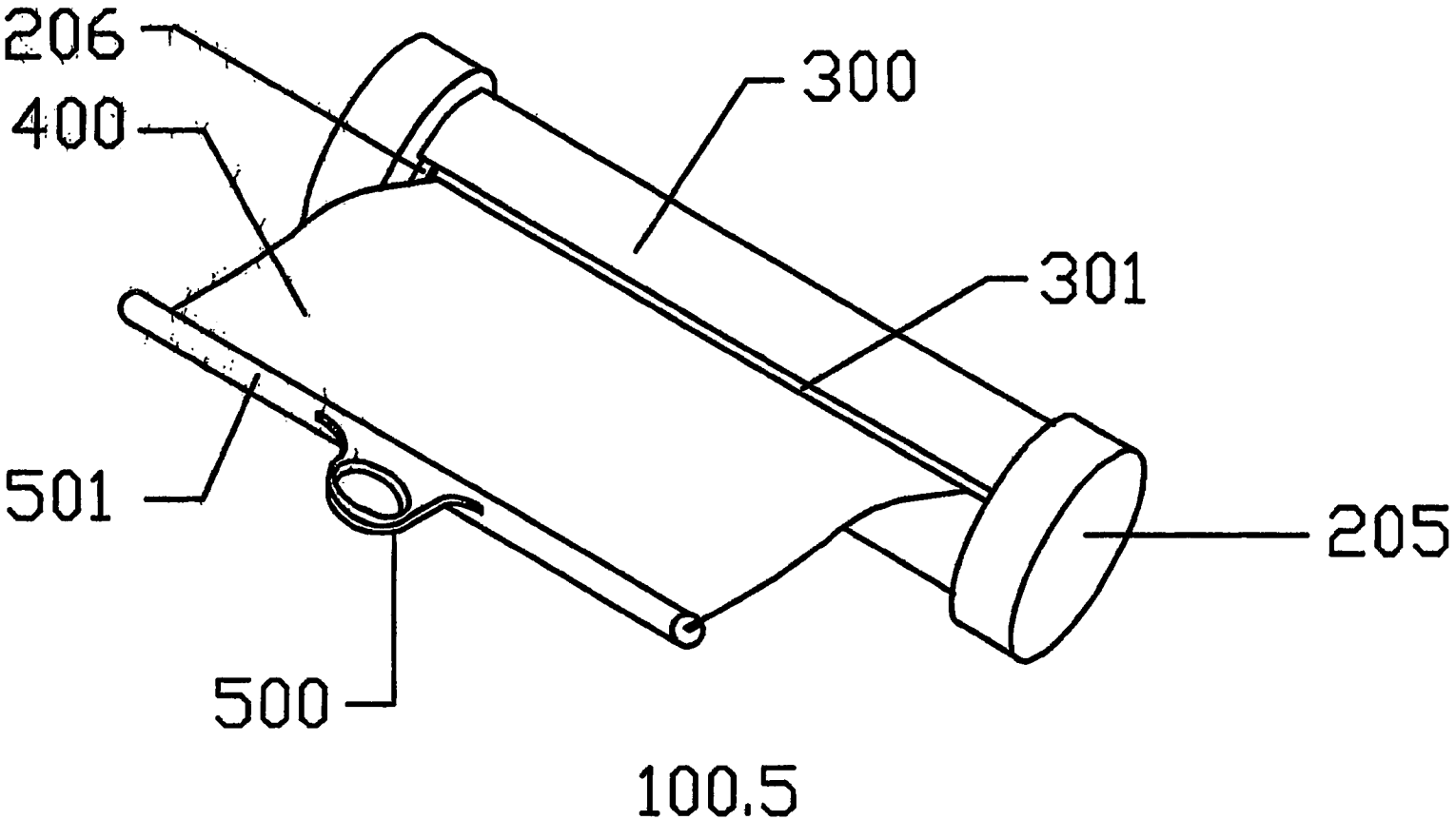
FIG. 8 illustrates the device handleless variation

FIG. 8 illustrates the handleless variation of the invention—100.5—wherein the floating cowling 300 is made of rigid material so that it may serve as the hand grip means and the retaining/aligning yokes 205 and 206, either one of which yokes can be threadably detachable, (this threaded detachability is not indicated in FIG. 8 but is mechanically as shown in FIG. 4: distal retaining/aligning yoke 203.1 and the threaded distal end 206, of spool-rod 202) are of an increased profile depth such that they can effectively be utilized in a dial-like manner to retract the printed material 400 within the floating cowling 300 through longitudinal slot 301.

The invention claimed is:

1. A hand held display device comprising a floating cowling comprising a tubular housing having a longitudinal slit;

a first spool rod retained within the tubular housing, the first spool rod having a distal end and a proximal end;

a distal aligning yoke coupled to the distal end of the first spool rod;

a proximal aligning yoke coupled to the proximal end of the first spool rod, the distal aligning yoke and the proximal aligning yoke configured to rotationally support and axially align the tubular housing around the first spool rod to allow free rotation of the tubular housing about the first spool rod;

a flexible material having a fixed end and a free end, the fixed end coupled to the first spool rod;

a pull tab coupled to the free end of the flexible material, the pull tab configured to prevent the free end of the flexible material from passing through the longitudinal slit into the tubular housing; whereby the flexible material is movable through the longitudinal slit between a retracted position having the flexible material wrapped around the first spool rod inside the tubular housing and an extended position having a majority of the flexible material outside the tubular housing;

wherein the distal aligning yoke has a distal raised annular ridge along an outer circumference of the distal aligning yoke; and wherein the proximal aligning yoke has a proximal raised annular ridge along the outer circumference of the proximal aligning yoke, the distal and proximal raised annular ridges configured to rotationally support and axially align the tubular housing around the first spool rod.

2. A hand held display device as in claim 1 further comprising a handle coupled to the proximal end of the first spool rod.

3. A hand held display device as in claim 1 wherein the tubular housing comprises flexible plastic material.

4. A hand held display device as in claim 1 wherein the distal aligning yoke is coupled to the distal end of the first spool rod via a threaded connection.

5. A hand held display device as in claim 4 wherein the tubular housing is comprised of one of rigid plastic, wood and metal.

6. A hand held display device comprising a tubular housing having a longitudinal slit;

a first spool rod retained within the tubular housing, the first spool rod having a distal end and a proximal end;

a distal aligning yoke coupled to the distal end of the first spool rod;

a proximal aligning yoke coupled to the proximal end of the first spool rod, the distal aligning yoke and the proximal aligning yoke configured to rotationally support and axially align the tubular housing around the first spool rod to allow free rotation of the tubular housing about the first spool rod;

a flexible material having a fixed end and a free end, the fixed end coupled to the first spool rod; whereby the flexible material is movable through the longitudinal slit between a retracted position having the flexible material wrapped around the first spool rod inside the tubular housing and an extended position having a majority of the flexible material outside the tubular housing;

wherein the tubular housing has two internal circumferential ridges configured to rotationally support the tubular housing with respect to the distal aligning yoke and the proximal aligning yoke.

7. A hand held display device comprising a tubular housing having a longitudinal slit;

a first spool rod retained within the tubular housing, the first spool rod having a distal end and a proximal end;

a distal aligning yoke coupled to the distal end of the first spool rod; a proximal aligning yoke coupled to the proximal end of the first spool rod, the distal aligning yoke and the proximal aligning yoke configured to rotationally support and axially align the tubular housing around the first spool rod to allow free rotation of the tubular housing about the first spool rod;

a flexible material having a fixed end and a free end, the fixed end coupled to the free end first spool rod;

whereby the flexible material is movable through the longitudinal slit between a retracted position having the flexible material wrapped around the first spool rod inside the tubular housing and an extended position having a majority of the flexible material outside the tubular housing; further comprising ski tip guides coupled to the tubular housing adjacent to the longitudinal slit, the ski tip guides configured to assist in retracting the flexible material through the longitudinal slit.

8. A hand held display device as in claim 7 wherein the tubular housing further comprises continuous outwardly rolled edges coupled to the tubular housing adjacent to the longitudinal slit, the continuous outwardly rolled edges configured to assist in retracting the flexible material through the longitudinal slit.

9. A hand-held display device as in claim 7 further comprising a second spool rod coupled to the free end of the flexible material.

* * * * *